US007323822B2

(12) United States Patent
Marcotte

(10) Patent No.: US 7,323,822 B2
(45) Date of Patent: Jan. 29, 2008

(54) PLASMA DISPLAY WITH SPLIT ELECTRODES

(75) Inventor: Robert G. Marcotte, New Paltz, NY (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 595 days.

(21) Appl. No.: 10/991,922

(22) Filed: Nov. 18, 2004

(65) Prior Publication Data

US 2005/0088377 A1 Apr. 28, 2005

Related U.S. Application Data

(63) Continuation of application No. 10/458,402, filed on Jun. 10, 2003, now Pat. No. 6,853,144.

(60) Provisional application No. 60/392,518, filed on Jun. 28, 2002.

(51) Int. Cl.
*G09G 3/10* (2006.01)

(52) U.S. Cl. ..... 315/169.1; 315/169.4; 315/169.2; 345/98; 345/68; 345/67

(58) Field of Classification Search .. 315/169.1–169.4; 345/60, 62–68, 90, 98; 313/582–585
See application file for complete search history.

(56) References Cited

U.S. PATENT DOCUMENTS 4,772,884 A 9/1988 Weber et al. ..... 345/67
4,812,017 A 3/1989 Piper ..... 349/144
5,852,347 A 12/1998 Marcotte ..... 315/169.4
5,998,935 A 12/1999 Marcotte ..... 315/169.4
6,054,970 A 4/2000 Hirakawa et al. ..... 345/60
6,118,214 A 9/2000 Marcotte ..... 313/582
6,184,848 B1 2/2001 Weber ..... 345/60
6,411,035 B1 6/2002 Marcotte ..... 313/585
6,611,099 B1 8/2003 Murata et al. ..... 313/582
6,628,075 B1 9/2003 Kim ..... 313/586
6,980,178 B2 * 12/2005 Lee et al. ..... 345/60
2004/0212566 A1 * 10/2004 Marcotte ..... 345/60
2004/0252080 A1 * 12/2004 Marcotte et al. ..... 345/60
2007/0075927 A1 * 4/2007 Moon ..... 345/63
2007/0103402 A1 * 5/2007 Cho ..... 345/68

* cited by examiner

*Primary Examiner*—Haissa Philogene
(74) *Attorney, Agent, or Firm*—Ohandt, Greeley, Ruggiero & Perle, L.L.P.

(57) ABSTRACT

There is provided a plasma display. The plasma display includes a circuit having a first input that receives a first waveform, a second input that receives a second waveform, an output that provides a driving waveform for an electrode of a pixel in the plasma display, and a switching sub-circuit. The switching sub-circuit (i) routes the first waveform from the first input to the output during a first portion of a setup period to initialize the pixel for an addressing operation, and (ii) routes the second waveform from the second input to the output during a second portion of the setup period.

24 Claims, 9 Drawing Sheets

400

500

PLASMA DISPLAY WITH SPLIT ELECTRODES

CROSS REFERENCE TO RELATED APPLICATIONS

The present application is a continuation of U.S. patent application Ser. No. 10/458,402, filed Jun. 10, 2003 now U.S. Pat. No. 6,853,144, which claims priority of U.S. Provisional Patent Application Ser. No. 60/392,518, filed on Jun. 28, 2002. The content of these prior applications is herein incorporated by reference.

BACKGROUND OF THE INVENTION

1. Field of the Invention

The present invention relates to plasma display panels, and more particularly, to a pixel architecture that minimizes vertical crosstalk between pixels and increases brightness.

2. Description of the Related Art

Color plasma display panels (PDPs) are well known in the art. Visible light is emitted by phosphors within the panel in response to gas plasma discharges between a pixel's sustain and scan electrode. During an addressing period, sustain electrodes are generally driven with a common potential, while scan electrodes are selected individually. Since the electrodes are on an internal surface of a front plate, the light produced must pass through the electrodes. When transparent electrodes, e.g., indium tin oxide (ITO), are employed, the light simply passes through the electrode. Alternatively, non-transparent apertured electrodes may be devised that allow the light to pass through open apertures in the electrode.

An embodiment of an AC color PDP is disclosed in U.S. Pat. No. 6,118,214 to Marcotte (hereinafter "the '214 patent) in which apertured electrodes are employed on a front plate. More particularly, the AC PDP includes horizontal pairs of apertured sustain electrodes that connect to a sustain bus. Pairs of independent scan apertured electrodes, are interdigitated with the pairs of common sustain electrodes. The apertured electrodes are generally produced using opaque metallic electrode materials such as silver or a film stack of chrome-copper-chrome.

Contrast enhancement bars are horizontally situated in inter-pixel gaps between horizontally adjacent pixels to reduce the light reflectivity of the phosphor. The contrast enhancement bars are opaque and may be conductive or non-conductive. For additional description of contrast enhancement bars, see U.S. Pat. No. 5,998,935 to Marcotte.

During processing, the electrodes are covered by a dielectric layer and a magnesium oxide (MgO) layer. A back plate supports vertical barrier ribs and plural vertical column conductors. The individual column conductors are covered with red, green, or blue phosphors, as the case may be, to enable a full color display to be achieved. The front and rear plates are sealed together and a space there between is filled with a dischargeable gas.

A pixel is a region at an intersection of electrodes. For example, a pixel is defined at an intersection of a sustain electrode and an adjacent scan electrode on the front plate and three back plate column electrodes for red, green, and blue. A sub-pixel, or sub-pixel site, refers to an intersection of individual red, green, and blue column electrodes with the front plate scan/sustain electrode pair.

The PDP operating voltage and power are controlled by the space between adjacent sustain and scan electrodes (hereinafter referred to as a sustain gap), the width of the lines making up the apertured electrodes, and the overall width of electrodes. The sustain and scan electrodes are generally placed to provide a relatively narrow sustain gap and a relatively wide inter-pixel gap.

Alternating sustaining discharges form at the sustain gap, and spread out vertically. The discharge forms a positive column region branching a positively charged anode electrode and a negative glow region drifts across a negatively charged cathode electrode. In the case of apertured electrodes, the line widths and spacing are balanced to maximize light transmission and to maximize discharge voltage uniformity. For example, minimizing the line width to 40-60 microns and spacing the horizontal lines at a distance less than or near the sustain gap dimension (e.g., 100 microns) achieves this balance. In the paired electrode configuration the electrodes on each side of the inter-pixel gap are at the same potential, therefore the inter-pixel gap must be made sufficiently large to prevent plasma discharges from spreading and corrupting an ON or OFF state of an adjacent pixel.

The overall width of the apertured electrodes, the line widths, the line spaces and the dielectric glass thickness over the electrode combine to determine the pixel's discharge capacitance, which controls the discharge power and therefore brightness. For a given discharge power and therefore brightness of each discharge, a number of discharges in a predetermined period of time is chosen to meet an overall brightness requirement for the panel.

The paired front plate electrode configuration of has the advantage of reduced inter-electrode capacitance, which reduces power dissipation resulting from charging and discharging of the inter-electrode capacitance of each sustain pulse. However, there is a possibility of vertical crosstalk resulting from the electrodes on either side of the inter-pixel gap being driven with the same potential. Vertical crosstalk occurs when a discharge at one discharge site spreads into a vertically adjacent discharge site, i.e., for an adjacent pixel, and affects the ON or OFF state of the adjacent pixel. The '214 patent utilizes a relatively large inter-pixel gap to help increase the vertical pixel to pixel isolation. Note that the back plate barrier ribs provide horizontal pixel isolation but no vertical isolation.

The greatest probability of vertical crosstalk occurs during the addressing period when each row is sequentially addressed to place desired sub-pixels in the ON state. In an addressing discharge, the plasma discharge forms between a selected scan electrode and a data electrode and the discharge's positive column spreads along the back plate data electrode to the sustain electrode. With an adjacent electrode at the same potential, the positive column can cross the inter-pixel gap and deplete the charge on an adjacent sub-pixel's sustain electrode. The presence of the contrast enhancement bar has been shown to have little effect on this address crosstalk mechanism.

SUMMARY OF THE INVENTION

The present invention relates to a pixel architecture for plasma display panels. Electrodes of the pixels are controlled to minimize vertical crosstalk between pixels and provide for increased brightness.

There is provided a method of controlling electrodes of a pixel in a plasma display panel. The method includes applying a first voltage to a first electrode of the pixel during an addressing discharge involving the first electrode, and applying a second voltage to a second electrode of the pixel.

The first voltage and the second voltage have a relationship that discourages the addressing discharge from extending to the second electrode.

Another method of controlling electrodes of a pixel in a plasma display panel includes applying a first voltage to a first electrode of a split electrode pair of the pixel, and applying a second voltage to a second electrode of the split electrode pair independently of the first voltage.

Another method of controlling electrodes of a pixel in a plasma display panel includes applying a first voltage to an inner scan electrode of the pixel during an addressing discharge between the inner scan electrode and a sustain electrode of the pixel, and applying a second voltage to an outer scan electrode of the pixel. The first voltage and the second voltage have a relationship that discourages the addressing discharge from extending to the outer scan electrode.

Yet another method of controlling electrodes of a pixel in a plasma display panel includes applying a voltage to an inner sustain electrode of the pixel during an addressing discharge between the inner sustain electrode and a scan electrode of the pixel, and applying a voltage to an outer sustain electrode of the pixel. The voltage to the inner sustain electrode and the voltage to the outer sustain electrode have a relationship that discourages the addressing discharge from extending to the outer sustain electrode.

Still another method of controlling electrodes of a pixel in a plasma display panel includes (a) applying a voltage waveform to an outer sustain electrode of the pixel, (b) applying a voltage waveform to an inner sustain electrode of the pixel, (c) applying a voltage waveform to an inner scan electrode of the pixel, and (d) applying a voltage waveform to an outer scan electrode of the pixel. The voltage waveform to the outer sustain electrode, the voltage waveform to the inner sustain electrode, the voltage waveform to the inner scan electrode and the voltage waveform to the outer scan electrode have relationships that (i) discourage an addressing discharge involving the inner sustain electrode and the inner scan electrode from extending to the outer sustain electrode and the outer scan electrode, and (ii) permit a sustaining discharge involving the inner sustain electrode and the inner scan electrode to extend to the outer sustain electrode and the outer scan electrode.

An embodiment of the present invention is an apparatus that includes a circuit for applying a first voltage to a first electrode of a pixel in a plasma display panel during an addressing discharge involving the first electrode, and a circuit for applying a second voltage to a second electrode of the pixel. The first and second voltages have a relationship that discourages the addressing discharge from extending to the second electrode.

Another apparatus includes a circuit for applying a first voltage to a first electrode of a split electrode pair of a pixel in a plasma display panel, and a circuit for applying a second voltage to a second electrode of the split electrode pair. The circuit for applying the first voltage and the circuit for applying the second voltage control the first electrode and the second electrode independently of one another.

Yet another apparatus includes (a) a circuit for applying a voltage waveform to an outer sustain electrode of a pixel in a plasma display panel, (b) a circuit for applying a voltage waveform to an inner sustain electrode of the pixel, (c) a circuit for applying a voltage waveform to an inner scan electrode of the pixel, and (d) a circuit for applying a voltage waveform to an outer scan electrode of the pixel. The voltage waveform to the outer sustain electrode, the voltage waveform to the inner sustain electrode, the voltage waveform to the inner scan electrode and the voltage waveform to the outer scan electrode have relationships that (i) discourage an addressing discharge involving the inner sustain electrode and the inner scan electrode from extending to the outer sustain electrode and the outer scan electrode, and (ii) permit a sustaining discharge involving the inner sustain electrode and the inner scan electrode to extend to the outer sustain electrode and the outer scan electrode.

Another embodiment of the present invention is a plasma display panel. The plasma display panel includes a pixel having a split electrode configured with a first electrode and a second electrode, and a circuit for (a) applying a first voltage to the first electrode during a discharge involving the first electrode, and (b) applying a second voltage to the second electrode. The first and second voltages have a relationship that influences whether the discharge extends to the second electrode.

Another plasma display panel includes a pixel having a split electrode configured with a first electrode and a second electrode, and a controller for applying a first voltage to the first electrode and a second voltage to the second electrode independently of one another.

Yet another plasma display panel includes a pixel having an outer sustain electrode, an inner sustain electrode, an inner scan electrode and an outer scan electrode, and a controller for applying voltages to each of the outer sustain electrode, inner sustain electrode, inner scan electrode and outer scan electrode independently of one another.

DESCRIPTION OF THE INVENTION

Elimination or suppression of vertical crosstalk between pixels allows for minimization of the size of an inter-pixel gap to maximize the pixel size thereby increasing brightness.

Figure 1:
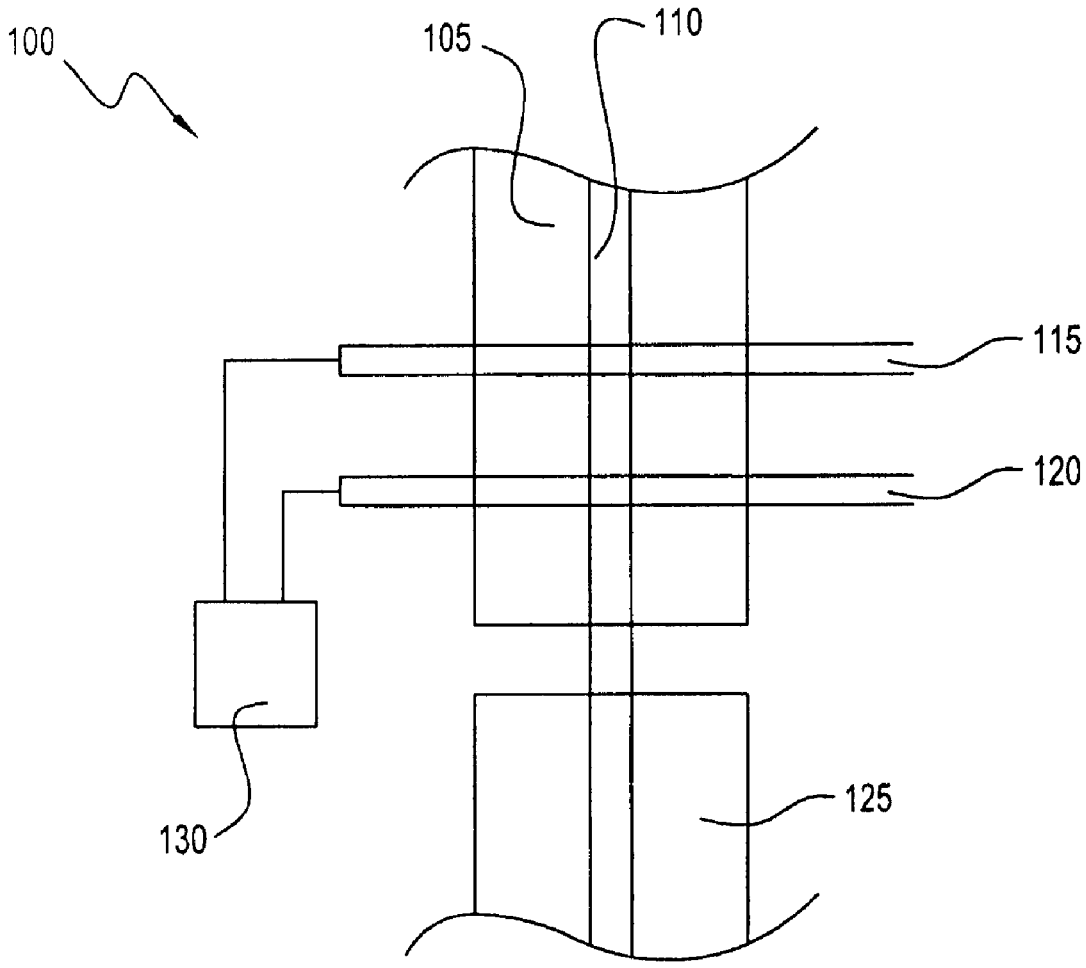
FIG. 1 is an illustration of a portion of a pixel configured in accordance with the present invention.

FIG. 1 is an illustration of a portion of a PDP 100, and more particularly a portion of a pixel 105 located at an intersection of a first electrode 115, a second electrode 120 and a data electrode 110. A controller 130 applies voltages to first electrode 115 and second electrode 120 to provide control of first electrode 115 and second electrode 120 independently of one another. The first voltage and the second voltage influence whether a discharge involving first electrode 115 extends to second electrode 120. First electrode 115 and second electrode 120 may operate as a split electrode.

During an addressing period, an addressing discharge is initiated between data electrode 110 and first electrode 115. During the addressing discharge, controller 130 applies a first voltage to first electrode 115, and applies a second voltage to second electrode 120. The first voltage and the second voltage have a relationship that discourages the addressing discharge from extending to second electrode 120.

Second electrode 120 is at an outer perimeter of pixel 105, thus first electrode 115 may be regarded as an inner electrode, and second electrode 120 may be regarded as an outer electrode. First electrode 115 may serve as an inner scan electrode where second electrode 120 serves as an outer scan electrode, such an arrangement being regarded as a split scan electrode. Similarly, first electrode 115 may serve as an inner sustain electrode where second electrode 120 serves as an outer sustain electrode, and similarly such an arrangement is regarded as a split sustain electrode.

A pixel 125 is vertically adjacent to pixel 105. As the addressing discharge is discouraged from extending to second electrode 120, it is also discouraged from extending to pixel 125. Thus, crosstalk from pixel 105 to pixel 125 is suppressed.

A pixel is an individually addressable picture element. The term sub-pixel is used herein to mean an individually addressable red, green or blue pixel. As a sub-pixel is individually addressable, it is also a form of pixel. Thus, the term "pixel", in general, can mean either (a) a sub-pixel of an individual color or (b) a red sub-pixel, a green sub-pixel and a blue sub-pixel in a group.

During a sustaining discharge involving first electrode 115, controller 130 applies a voltage to first electrode 115, and applies a voltage to second electrode 120 to encourage the sustaining discharge to extend to second electrode 120.

Although not represented in FIG. 1, first electrode 115 and second electrode 120 may be two electrodes of a split electrode pair. Furthermore, pixel 105 may be configured to have two split electrode pairs, namely, a split sustain electrode and a split scan electrode. The split sustain electrode is configured with an outer sustain electrode and an inner sustain electrode. The split scan electrode is configured with an inner scan electrode and an outer scan electrode.

On alternating sustaining discharges, a voltage is applied to the inner scan electrode or the inner sustain electrode while another voltage is applied to the outer scan electrode or the outer sustain electrode respectively. As the voltage applied to the outer scan electrode or the outer sustain electrode is increased above a minimum required voltage to effectively discharge the outer scan electrode or outer sustain electrode, additional brightness may be achieved as discharge power is increased.

Figure 2:
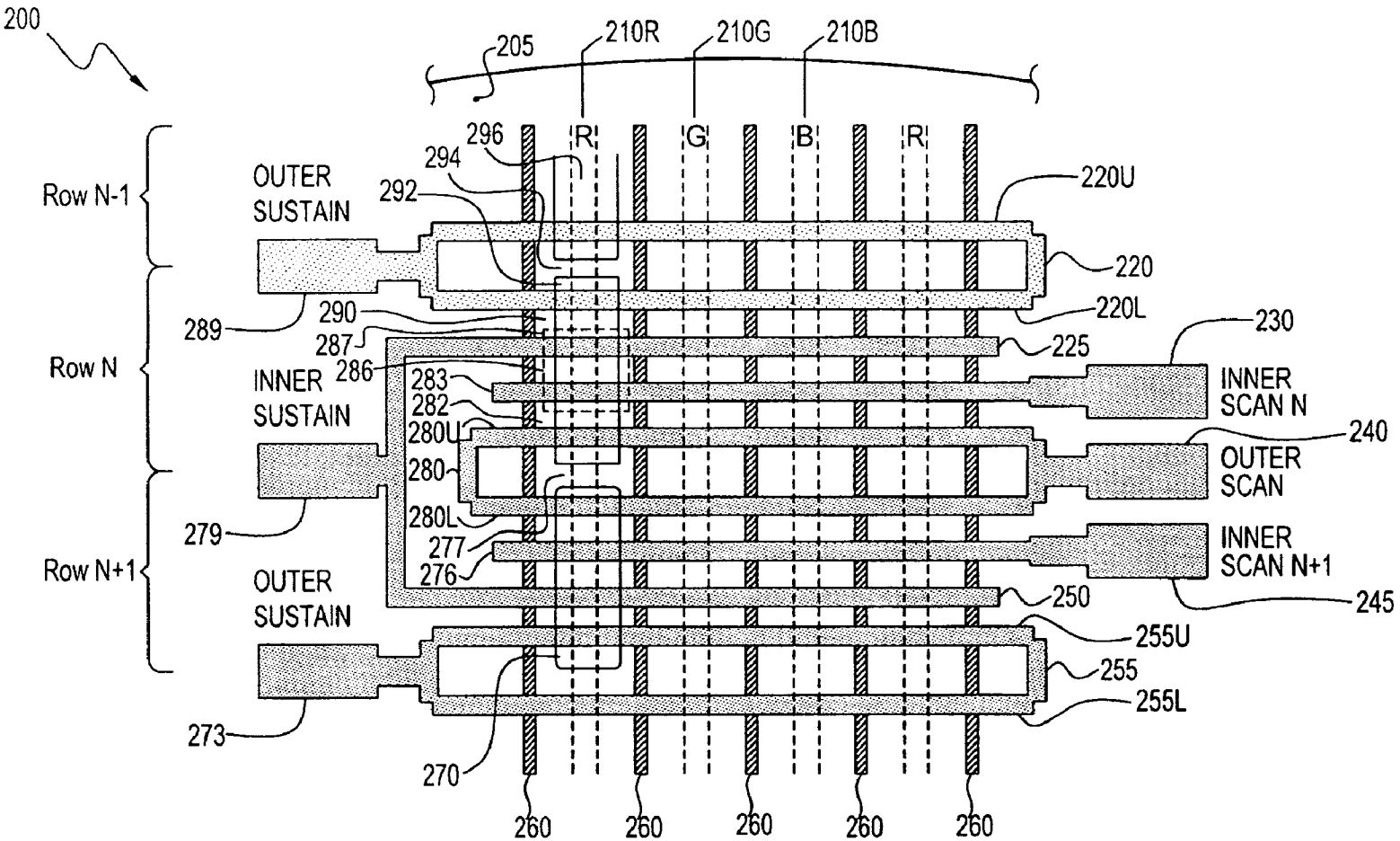
FIG. 2 is an illustration of a portion of a PDP configured with split electrodes.

FIG. 2 is an illustration of a portion of a PDP 200 configured with split electrodes. Additionally, as explained below, some of the electrodes of PDP 200 are also configured as loop electrodes. A loop electrode services two adjacent pixel discharge sites separated by an inter-pixel gap. For further information relating to loop electrodes, see U.S. Pat. No. 5,852,347 to Marcotte. Additionally, an isolated or non-conductive contrast enhancement bar may be placed within the loop electrode to reduce light reflectivity.

PDP 200 includes outer sustain electrode terminals 289 and 273, an inner sustain electrode terminal 279, inner scan electrode terminals 230 and 245, and an outer scan electrode terminal 240. Outer sustain electrode terminal 289 is connected to an outer sustain electrode 220. Inner sustain electrode terminal 279 is connected to inner sustain electrodes 225 and 250. Inner scan electrode terminal 230 is connected to an inner scan electrode 283. Outer scan electrode terminal 240 is connected to an outer scan electrode 280. Inner scan electrode terminal 245 is connected to an inner scan electrode 276. Outer sustain electrode terminal 273 is connected to an outer sustain electrode 255.

Outer sustain electrode 220 is configured as a loop electrode having an upper portion 220U and a lower portion 220L. Upper portion 220U services a sub-pixel 296, and lower portion 220L services a sub-pixel 292. Outer sustain electrode 200 has an interior region between upper portion 220U and lower portion 220L that provides an inter-pixel gap 294 between sub-pixels 296 and 292.

Outer scan electrode 280 is configured as a loop electrode having an upper portion 280U and a lower portion 280L. Upper portion 280U services sub-pixel 292, and lower portion 280L services a sub-pixel 270. Outer scan electrode 280 has an interior region between upper portion 280U and lower portion 280L that provides an inter-pixel gap 277 between sub-pixels 292 and 270.

Outer sustain electrode 255 is configured as a loop electrode having an upper portion 255U and a lower portion 255L. Upper portion 255U services sub-pixel 270, and lower portion 255L services an adjacent sub-pixel (not shown).

PDP 200 also includes a back plate 205 having vertical barrier ribs 260 and data electrodes 210R, 210G, and 210B, which are coated with red, green, or blue phosphor, respectively. Barrier ribs 260 maintain a substrate gap between a front plate (not represented in FIG. 2) and back plate 205 and also separate data electrodes 210R, 210G, and 210B from one another.

Back plate 205 may be fabricated either with or without horizontal pixel separators (not shown). Horizontal pixel separators are center aligned within the front plate inter-pixel gaps 294 and 277, to prevent discharge crosstalk between vertically adjacent pixel sites. As the outer scan or sustain electrode voltages are increased for added brightness, such separators become advantageous.

Sub-pixel 292 is located at the intersection of data electrode 210R, outer sustain electrode lower portion 220L, inner sustain electrode 225, inner scan electrode 283, and outer scan electrode upper portion 280U. Sub-pixel 292 is in a row, arbitrarily designated as row N. Sub-pixel 292 includes a sustain gap 286 between inner sustain electrode 225 and inner scan electrode 283. It also includes a gap 290 between outer sustain electrode lower portion 220L and inner sustain electrode 225, and a gap 282 between inner scan electrode 283 and outer scan electrode upper portion 280U. In general, gaps 290 and 282 are the same size as one another.

Sub-pixel 270 is in a row N+1, adjacent to sub-pixel 292. Note that sub-pixel 270 is located at an intersection of data electrode 210R, and outer scan electrode lower portion 280L, inner scan electrode 276, inner sustain electrode 250, and outer sustain electrode upper portion 255U.

Sub-pixel 296, only a portion of which is shown in FIG. 2, is in a row N−1, adjacent to sub-pixel 292. Note that sub-pixel 296 is located at an intersection that includes data electrode 210R and outer sustain electrode upper portion 220U.

Outer sustain electrode lower portion 220L and inner sustain electrode 225 are collectively referred to as a split sustain electrode. Similarly, inner scan electrode 283 and outer scan electrode upper portion 280U are collectively referred to as a split scan electrode. Gaps 290 and 282 are then referred to as split electrode gaps.

Outer sustain electrode lower portion 220L is at an upper outer perimeter of sub-pixel 292, and outer scan electrode upper portion 280U is at a lower outer perimeter of sub-pixel 292. During addressing periods, outer sustain electrode 220 is electrically driven to discourage vertical crosstalk between sub-pixel 292 and sub-pixel 296. Likewise during addressing, outer scan electrode 280 is driven to discourage, and preferably prevent, crosstalk between sub-pixel 292 and sub-pixel 270. As a result, addressing discharges are limited to an inner electrode area 287, reducing addressing discharge current as compared to discharging the entire sub-pixel 292. During alternating sustaining discharges of sub-pixel 292, outer scan electrode 280 is driven to encourage the discharge to extend beyond inner scan electrode 283, and discharge outer scan electrode upper portion 280U. Inter-pixel gap 277 is sized to prevent vertical crosstalk, and/or horizontal separators are included in the fabrication of barrier ribs 260 at the center of inter-pixel gap 277. Similarly, outer sustain electrode 220 is driven to encourage the discharge to extend beyond inner sustain electrode 225, and discharge outer sustain electrode lower portion 220L. Inter-pixel gap 255 is sized to prevent vertical crosstalk, and/or horizontal separators are included in the fabrication of barrier ribs 260 at the center of inter-pixel gap 294.

Figure 3:
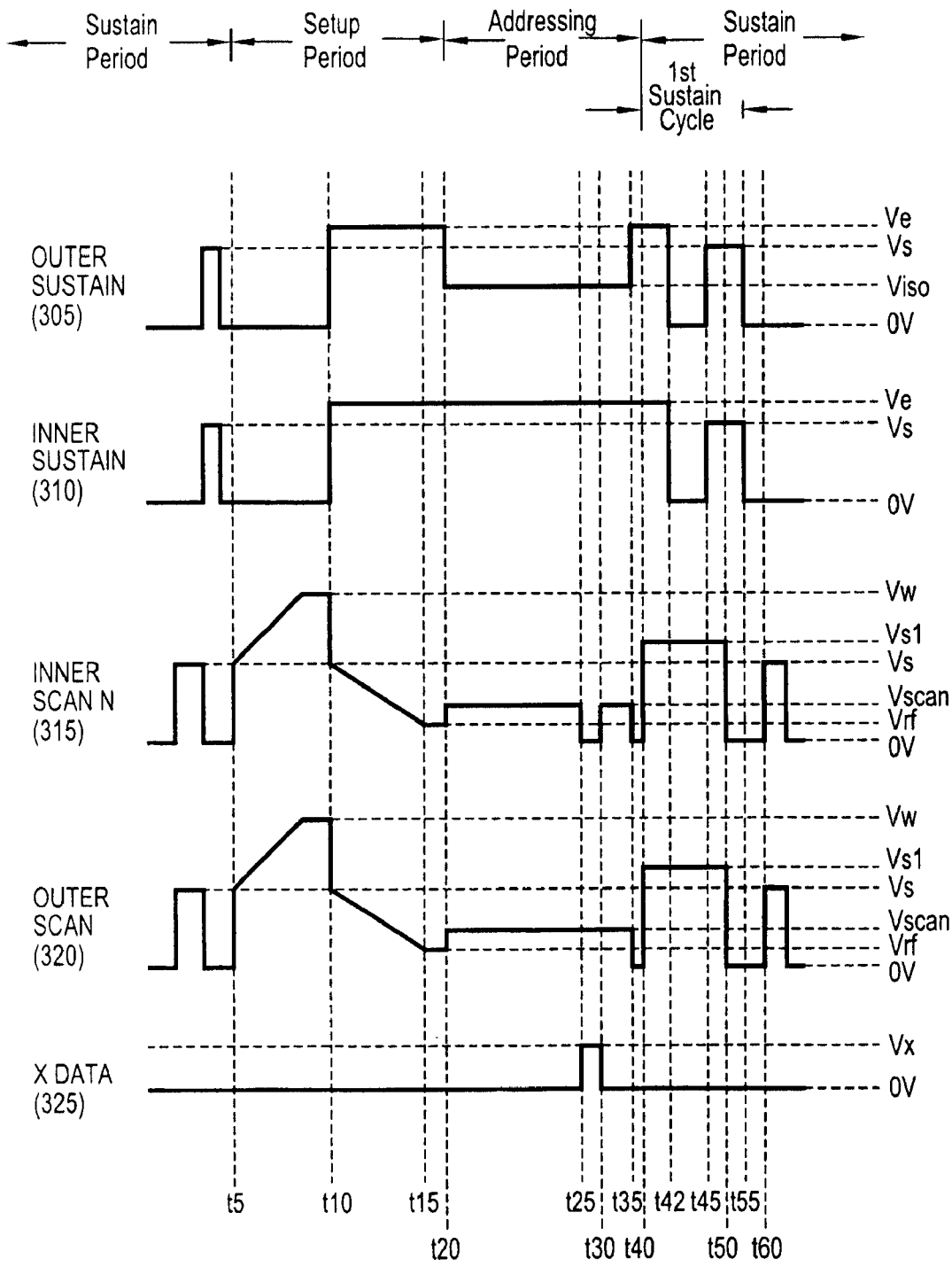
FIG. 3 is a graph of a set of voltage waveforms for driving the electrodes of FIG. 2.

FIG. 3 is a graph of a set of voltage waveforms for driving the electrodes of FIG. 2. For example, an outer sustain waveform 305 drives outer sustain electrode 220, an inner sustain waveform 310 drives inner sustain electrode 225, an inner scan waveform 315 drives inner scan electrode 283, an outer scan waveform 320 drives outer scan electrode 280, and X data waveform 325 drives data electrode 210R. The horizontal axis of FIG. 3 represents time and the vertical axis represents voltage, however, neither of the horizontal nor vertical axis is drawn to scale.

Plasma displays partition a 60 Hz display frame into 8 to 12 pulse width modulated sub-fields. Each sub-field produces a portion of the light required to achieve a proper intensity of each pixel. Each sub-field is partitioned into a setup period, an addressing period and a sustain period. The sustain period is further partitioned into a plurality of sustain cycles. The waveforms of FIG. 3 apply to one such sub-field, and the left hand side of FIG. 3 shows an end of a sustain period of a previous sub-field.

A current sub-field begins with a setup period, which resets any ON sub-pixels to an OFF state, and provides priming to the gas and MgO surface to allow for subsequent addressing. The intent is to place each sub-pixel at a voltage very close to a firing voltage of the gas. For example, when setting up sub-pixel 292, during time t5-t15 weak discharges are produced such that a resulting voltage, within the panel, between data electrode 210R and inner sustain electrode 225, relative to a voltage on inner scan electrode 283, is the gas mixture's firing voltage.

After each sub-pixel is setup, the addressing period begins. In the addressing period, each row may be sequentially selected via a row select pulse, as shown on inner scan waveform 315 for a row N at t25-t30. If concurrently, a data voltage is applied to a sub-pixel's data electrode, e.g., a pulse at time t25 on the X data waveform, then an addressing discharge will occur, setting the sub-pixel into the ON state.

On inner scan waveform 315 there is a row select pulse at time t25 to select row N, i.e., the row in which inner scan electrode 283 is located. Note that a row select for inner scan electrode 276, which is in row N+1, would be applied at a time other than time t25. Note also that inner scan waveform 315 and outer scan waveform 320 are identical to one another, except for the row select pulse at time t25. Also during the addressing period, and more particularly during an interval from time t20 to time t35, outer sustain waveform 305 is at a voltage Viso, while inner sustain waveform 310 is at a voltage Ve, where Viso is less than Ve.

X data waveform 325 has a positive going data pulse at time t25. This data pulse being concurrent with the row select pulse on inner scan waveform 315 at time t25, initiates an addressing discharge in sustain gap 286 to turn ON sub-pixel 292. The addressing discharge forms between data electrode 210R and inner scan electrode 283. Moments after the addressing discharge is initiated, the positive column of the discharge spreads across sustain gap 286 to inner sustain electrode 225.

During the addressing period, since outer sustain electrode 220 is driven negatively (Viso) with respect to inner sustain electrode 225 (Ve), the addressing discharge will not progress across gap 290 to outer sustain electrode lower portion 220L. Similarly, since outer scan electrode 280 is driven positively to a voltage Vscan, which is the row de-select voltage, the addressing discharge is prevented from progressing across gap 282 to outer scan electrode upper portion 280U. Since the discharge currents are proportional to the discharge electrode area, the addressing discharge currents are greatly diminished as the addressing area 287 is an area between inner sustain electrode 225 and inner scan electrode 283 in sub-pixel 292.

After being addressed, a sub-pixel is repetitively discharged in the sustain period to produce a desired brightness.

In the sustain period, if sub-pixel 292 was addressed during the addressing period, i.e., if an addressing discharge was initiated at time t25, then a number of sustaining discharges are produced in sustain gap 286. The number of sustaining discharges produced in the sustain period is related to the desired brightness for sub-pixel 292. Each sub-field typically has a different number of sustain pulses within a sustain period.

In the sustain period, outer sustain waveform 305 and inner sustain waveform 310 are identical to one anther, and inner scan waveform 315 and outer scan waveform 320 are identical to one another. Accordingly, for convenience, when discussing the sustain period, (a) outer and inner sustain waveforms 305 and 310 are collectively referred to as the sustain waveform, and (b) inner and outer scan waveforms 315 and 320 are collectively referred to as the scan waveform. Pulses of voltage Vs are applied to outer and inner sustain electrodes 220 and 225, and alternated with pulse of voltage Vs being applied to inner and outer scan electrodes 283 and 280, to repetitively discharge sub-pixel 292.

A first sustaining discharge occurs between times t42 and t45. At times t40 and t42, the sustain waveform and scan waveform voltage polarities are reversed with respect to the addressing period so that the first sustaining discharge will produce a current flow from the scan electrode toward the sustain electrode. Between time t42 and t45, a sustaining discharge forms at sustain gap 286 with the positive column spreading across inner scan electrode 283, gap 282, and outer scan electrode upper portion 280U. That is, during the sustain period, the sustaining discharges are permitted to extend to outer scan electrode upper portion 280U. The scan waveform provides a high sustain voltage Vs1 to inner and outer scan electrodes 283 and 280, thus providing ample voltage for the positive column to spread quickly across gap 282. As a result, gap 282 can be wider than sustain gap 286. As the slow moving negative glow expands due to the larger positive column it spreads across inner sustain electrode 283, gap 290, and outer sustain electrode lower portion 220L.

Such an embodiment can be operated with line widths from 40 to 100 microns and with sustain gap and split electrode gaps of 60 to 120 microns. Since the light must pass around opaque electrodes, it is advantageous to have narrower lines and larger spaces.

Figure 4:
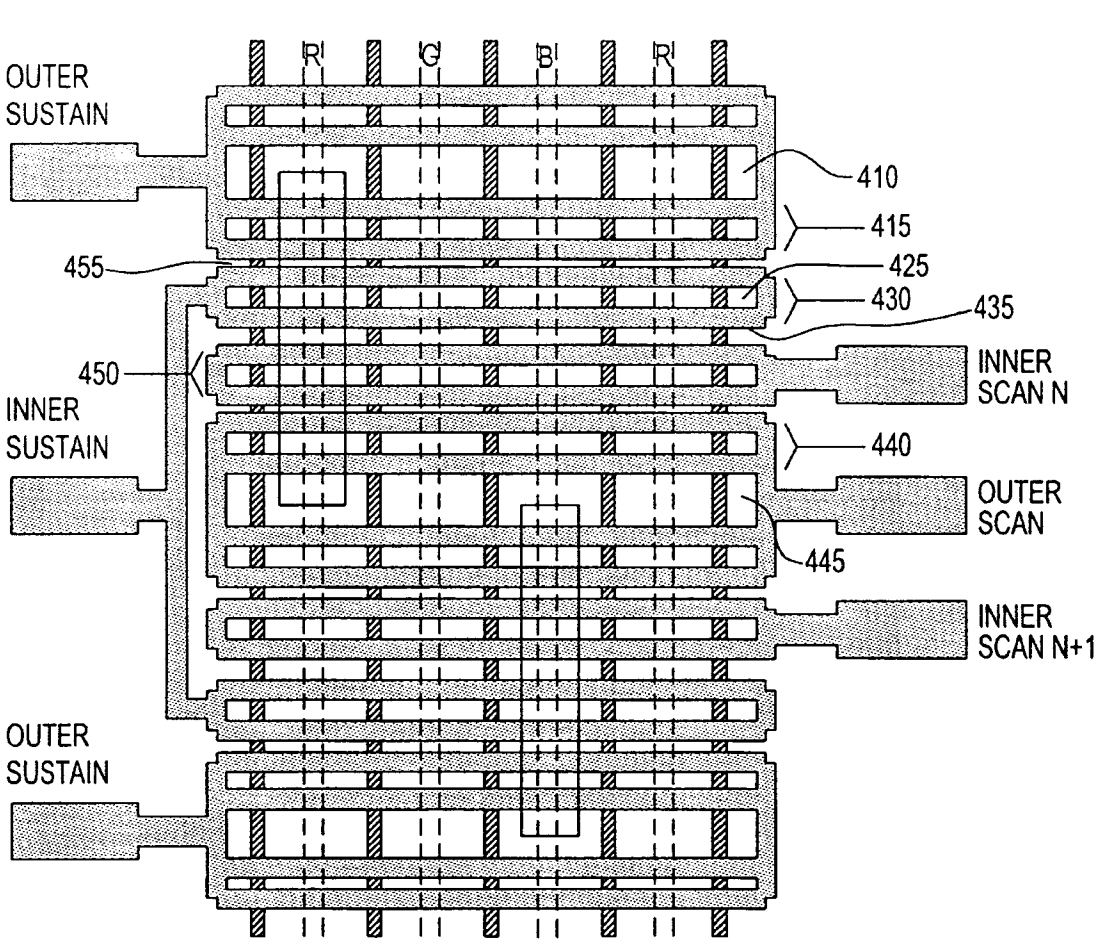
FIG. 4 is an illustration of a portion of a PDP configured with split electrodes having horizontal electrode lines with shorting bars at each end.

FIG. 4 is an illustration of a portion of a PDP 400, similar to that of PDP 200, where in place of electrodes 220L, 225, 283 and 280U, there are non-transparent apertured electrodes 415, 430, 450 and 440 respectively. Each apertured electrode includes two opaque horizontal lines, e.g., 420 and 435, enclosing an aperture, e.g., 425. Similarly to PDP 200, the outer sustain apertured electrodes and outer scan apertured electrodes are looped about inter-pixel gaps 410 and 445. In such a configuration, each apertured electrode will behave, as a solid electrode provided its aperture is not too large. Typical electrode line widths of 40 microns and apertures of 80 microns provide such a characteristic. Consequently, it is advantageous to make gap 455 equal to the spacing of aperture 425. Additional shorting bars (not shown) may be placed within apertures, e.g., within aperture 425, to bypass photolithographic open defects. For example, see U.S. Pat. No. 6,411,035 to Marcotte.

The configuration of two horizontal lines, e.g., 420 and 435, forming the apertured electrodes of PDP 400, can be modified to vary the number of horizontal lines and apertures in either the outer apertured electrodes, e.g., electrodes 415 or 440, or the inner apertured electrodes, e.g., electrodes 430 or 450, to control a ratio of addressing discharge capacitance versus sustaining discharge capacitances. For example, a single horizontal electrode line could be implemented for the inner scan and inner sustain electrodes as in FIG. 2, e.g., inner sustain electrode 225 and inner scan electrode 283, while three or more horizontal electrode lines could be implemented to widen the outer apertured electrodes, 415 and 440.

The apertured electrode configuration of PDP 400 allows for larger pixels to be fabricated than that of PDP 200. Since the operating characteristics are determined by the horizontal line width and spacing, increasing the horizontal line width, the spacing between horizontal lines, or the number of horizontal lines and spaces can extend the pixel size. As the pixel size is extended it is generally necessary to increase the sustain pulse voltage to ensure that the discharges extend to the outer edges of each sub-pixel.

Figure 5:
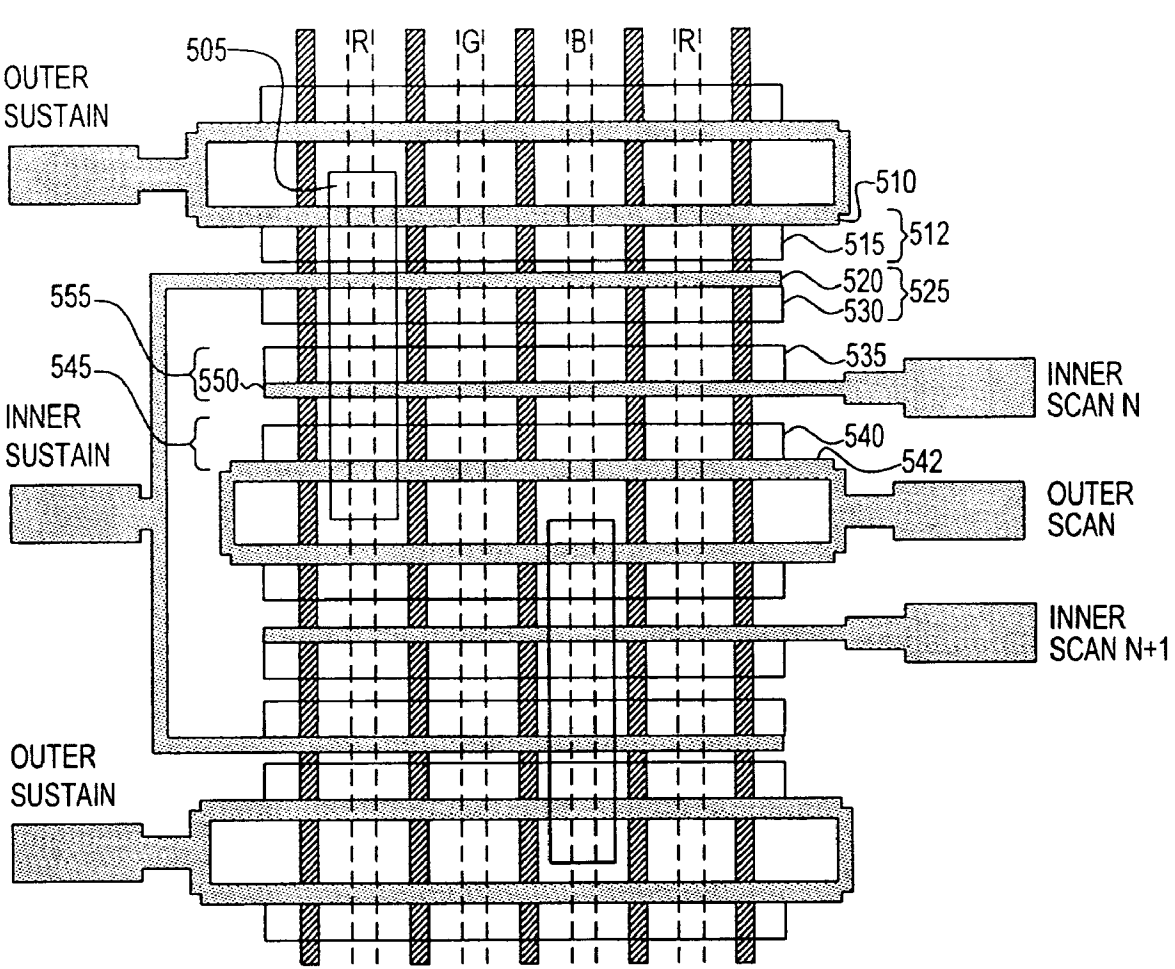
FIG. 5 is an illustration of embodiment of a PDP where an electrode is formed as transparent electrode overlaid with a metallic bus electrode.

FIG. 5 is an illustration of embodiment of a portion of a PDP 500 where an electrode includes an electrically conductive transparent region, i.e., a transparent electrode. PDP 500 has a sub-pixel 505 at an intersection of an outer sustain electrode 512, an inner sustain electrode 525, an inner scan electrode 555 and an outer scan electrode 545. Outer sustain electrode 512 is configured with a transparent electrode 515 overlaid with a portion of an opaque metallic loop electrode 510. Inner sustain electrode 525 is configured with a transparent electrode 530 overlaid with a metallic bus electrode 520. Inner scan electrode 555 is configured with a transparent electrode 535 overlaid with a metallic bus electrode 550. Outer scan electrode 545 is configured with a transparent electrode 540 overlaid with a portion of an opaque metallic loop electrode 542.

This configuration of electrodes, i.e., a transparent electrode overlaid with a metal electrode, provides high brightness and excellent brightness uniformity. The high brightness results from high discharge capacitance. With high discharge capacitance, large discharges are much more apt to over spread and create vertical crosstalk. Additionally, the high capacitance reduces addressing operating margin due to voltage drops caused by high addressing discharge currents. Accordingly, on inner sustain electrode 525 and inner scan electrode 555, the transparent conductor width of transparent electrodes 530, 535 may be reduced or removed to reduce the address currents, and on outer sustain electrode 512 and outer scan electrode 545, transparent electrodes 515 and 540 may be widened to supply increased sustaining discharge power.

Figure 6:
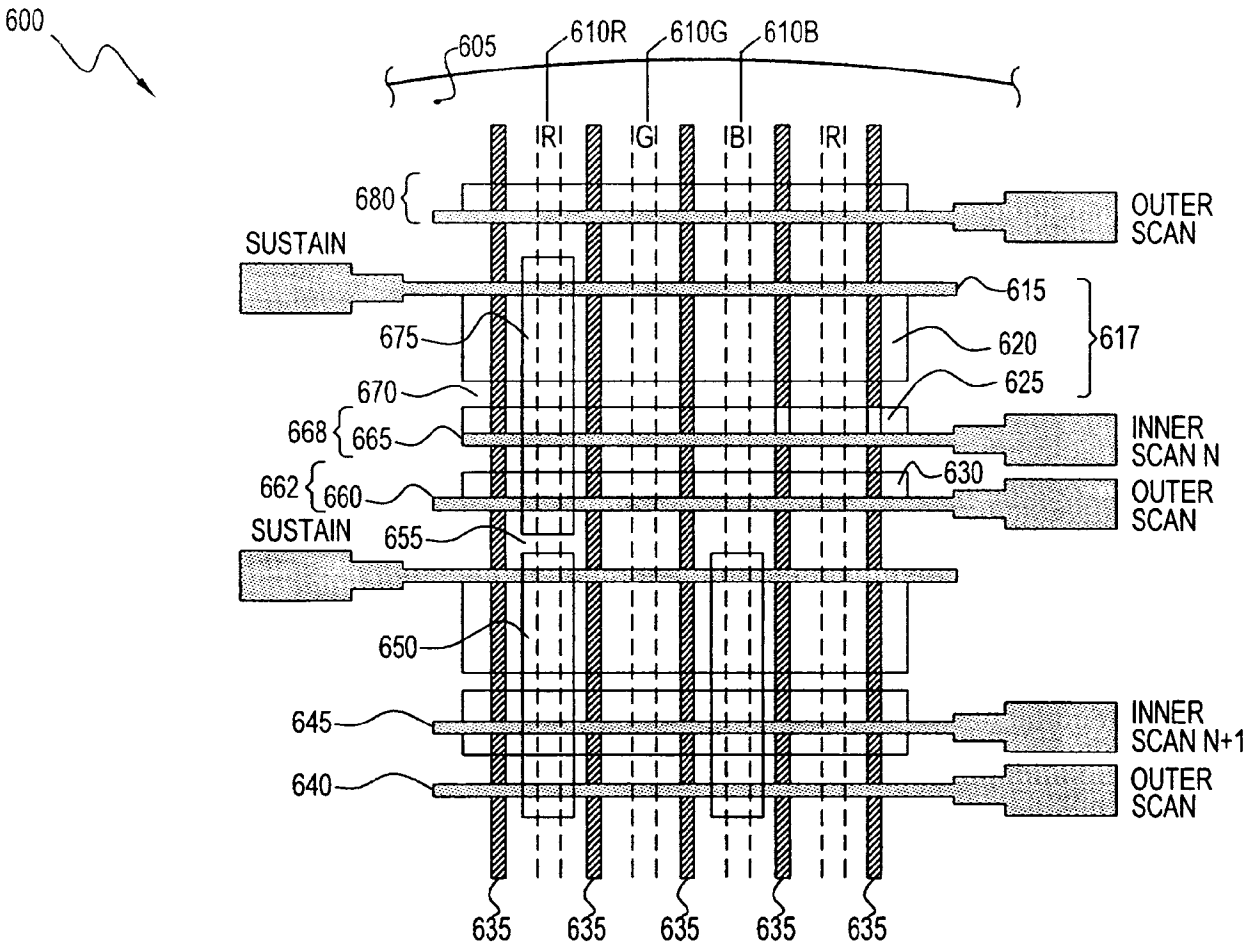
FIG. 6 is an illustration of a portion of a PDP having a sub-pixel with a three-electrode configuration.

FIG. 6 is an illustration of a portion of a PDP having a sub-pixel with a three-electrode configuration. A PDP 600 includes a back plate 605 having vertical barrier ribs 635 and data electrodes 610R, 610G and 610B coated with red, green, or blue phosphor, respectively. PDP 600 also includes a sustain electrode 617, an inner scan electrode 668, and an outer scan electrode 662.

Sustain electrode 617 is configured with a transparent electrode 620 overlaid with a metallic electrode 615. Inner scan electrode 668 is configured with a transparent electrode 625 overlaid with a metallic electrode 665. Outer scan electrode 662 is configured with a transparent electrode 630 overlaid with a metallic electrode 660. The metallic electrode material is an opaque metallic conductor.

A sub-pixel 675 is in a region at an intersection of data electrode 610R, sustain electrode 617, inner scan electrode 668, and outer scan electrode 662. Sub-pixel 675 is in a row N, and is vertically adjacent to a sub-pixel 650 in a row N+1. An outer scan electrode 680 is for a row N−1. A sustain electrode 632, an inner scan electrode 645 and an outer scan electrode 640 are for row N+1. An inter-pixel gap 655 lies between sub-pixels 675 and 650.

Sub-pixel 675 includes a sustain gap 670 located between sustain electrode 617 and inner scan electrode 668. Outer scan electrode 662 is at an outer perimeter of sub-pixel 675, and thus also borders inter-pixel gap 655. Outer scan electrode 662 is electrically driven to discourage vertical crosstalk from sub-pixel 675 to sub-pixel 650.

During an addressing discharge involving inner scan electrode 668, a first voltage is applied to inner scan electrode 668, and a second voltage is applied to outer scan electrode 662. By selecting appropriate levels for the first and second voltages, the addressing discharge that forms between back plate 605 and inner scan electrode 668 is discouraged from extending to outer scan electrode 662. The positive column will quickly engulf sustain electrode 617 while the negative glow will be limited to inner scan electrode 668.

Addressing current is limited by capacitance of inner scan electrode 668. Since outer scan electrode 660 is not involved in the discharge, the current is limited. PDP 600 offers improved brightness over PDP 500 due to the larger area of transparent electrode 620, and less light shading than that caused by metallic bus electrode 520.

Although PDP 600 is shown as being configured with sustain electrode 617, inner scan electrode 668 and outer scan electrode 662, the concept of suppressing vertical crosstalk can also be employed with inner and outer sustain electrodes. For example, sustain electrode 617 can be replaced with an inner sustain electrode and an outer sustain electrode that are controlled independently of one another to further limit the addressing discharge current. Thus, either or both of the sustain electrode and scan electrode can be configured with an outer electrode and an inner electrode.

Figure 7:
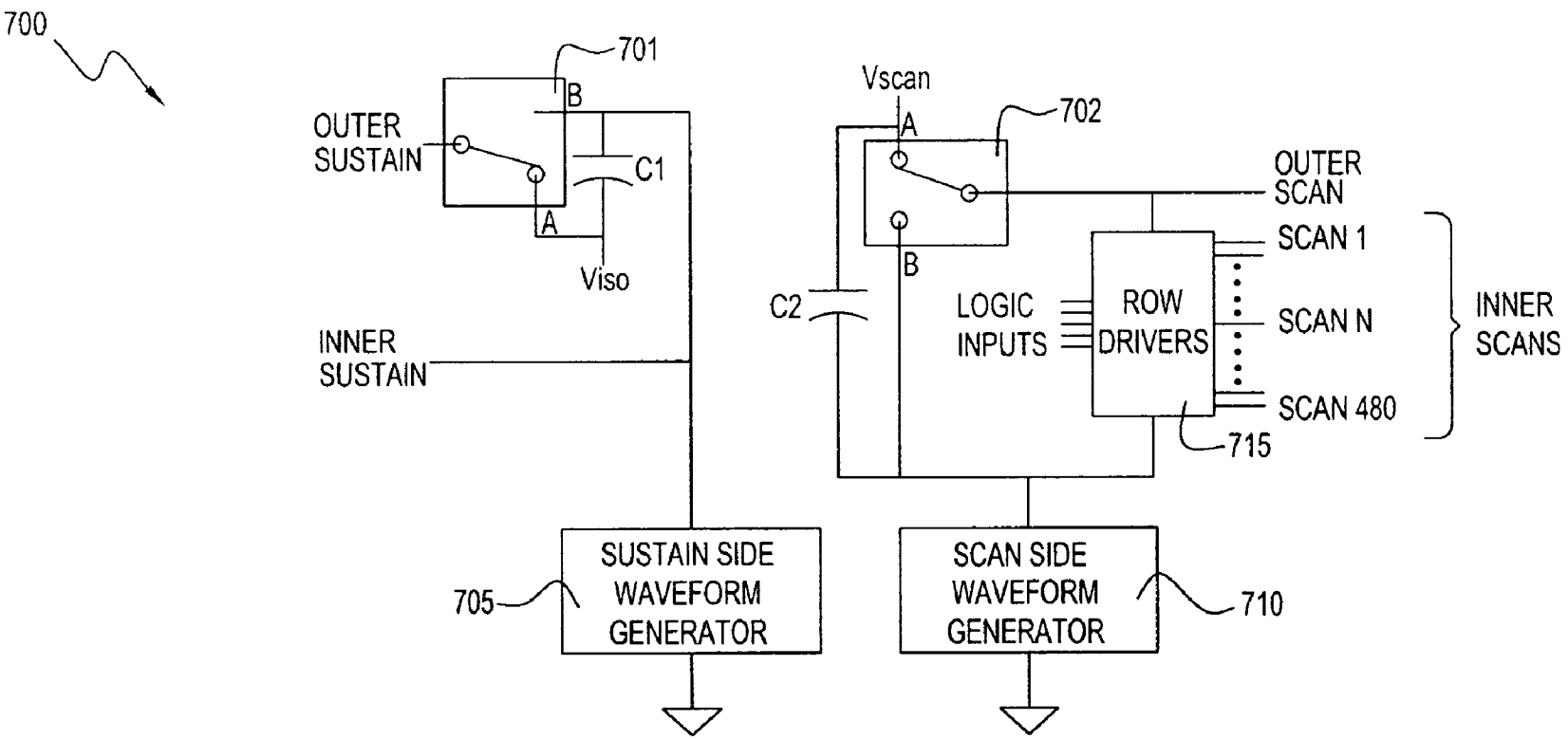
FIG. 7 is a block diagram of a circuit for producing the waveforms of FIG. 3.

FIG. 7 is a block diagram of a circuit 700 for producing the waveforms of FIG. 3. Circuit 700 is, in turn, composed of smaller circuits for controlling an outer sustain electrode, an inner sustain electrode, and inner scan electrode and an outer scan electrode independently of one another. Circuit 700 includes a sustain side waveform generator 705 and a scan side waveform generator 710.

Sustain side waveform generator 705 generates a sustain waveform Vss that serves as a source for inner sustain waveform 310. The sustain waveform Vss from sustain side waveform generator 705 is also routed to a switch 701 to serve as a source for outer sustain waveform 305.

Scan side waveform generator 710 generates a scan waveform Vsc. The scan waveform Vsc is presented to row drivers 715 that drive rows of scan lines, e.g., scan line 1 through scan line 480, and thus serves as a source for inner scan waveform 315 for row N. The scan waveform Vsc from scan side waveform generator 710 is also routed to a switch 702 to serve as a source for outer scan waveform 320.

Each of switches 701 and 702 can be set to either a position A or a position B. In FIG. 7, switches 701 and 702 are shown in position A as they would be connected from time t20 to time t35 (see FIG. 3) during the addressing period to provide voltages for controlling the outer sustain electrode and the outer scan electrode to restrain the addressing discharge.

Referring to the sustain side, the inner sustain electrodes are driven directly from sustain side waveform generator 705, and the outer sustain electrodes are driven either by the output sustain side waveform generator 705 (via switch 701 position B) or by isolation voltage Viso (via switch 701 position A). The isolation voltage Viso is a non-grounded voltage, for example, floating 50 to 100 volts below the output voltage of sustain side waveform generator 705.

On the scan side, row drivers 715 are totem pole output row drivers that scan each row during the addressing period. There is a separate output for each display row connected to a respective inner scan electrode through terminals 230 and 245.

Voltage Vscan is AC coupled from scan side waveform generator 710, through capacitors C2, and therefore floats with the output of scan side waveform generator 710. Vscan floats about 75-150 volts over the output of scan side waveform generator 710. The outer scan electrodes and the high side of the totem pole outputs within row drivers 715 are tied to a common point of switch 702, which provides a positive voltage relative to the output of scan side waveform generator 710. This positive voltage provides a row de-select level during the addressing period.

During the addressing period, each inner scan electrode is sequentially pulsed low by row driver 715, to 0 V, to enable addressing of a selected row. An addressing discharge will then form at each sub-pixel site where an X-data electrode is driven to 50-75 volts.

During time periods other than the addressing period, switches 701 and 702 are set to position B so that the outer sustain electrode is driven directly from sustain side waveform generator 705, and the outer scan electrode is driven directly from scan side waveform generator 710.

Each of the embodiments described herein reduces the peak addressing discharge current, which occurs when all the pixels on a given line are addressed, and so lessens the current requirements of row drivers 715. Furthermore, the sustaining discharge currents occurring during the sustain period are channeled from the outer scan electrodes through switch 702, around, not through, row drivers 715. The sustain currents from the individual inner scan electrodes will flow through the lower transistor of the totem pole outputs of row drivers 715. In practice, each switch 701 and 702 uses a pair of high current transistors such as metal oxide semiconductor transistors (MOSFETs) or insulated gate bipolar transistors (IGBTs).

When scan and sustain electrodes are configured as split electrodes, (i.e., inner and outer scan electrodes, and inner and outer sustain electrodes), alternate driving techniques may be devised to utilize the split electrode configuration to further improve operating characteristics.

A first driving technique improves dark screen contrast ratio. Background glow light, produced by a setup voltage waveform producing a weak setup discharge, is contained to a center region of each sub-pixel site. Such a setup voltage waveform drives the outer electrodes with lower setup voltages while the prior voltage levels are used to drive the inner electrodes to discourage the setup discharge from extending to the outer regions of each sub-pixel. Reducing the setup discharge area, reduces the setup discharge light, and therefore improves the dark screen contrast ratio.

A second driving technique applies to the sustain time period. The outer electrodes of each split electrode pair are driven with higher sustain pulse voltages providing additional voltage to the outer electrodes to draw the discharge to the outer limits of each sub-pixel site. This allows the sustain voltage itself to be reduced which improves sustain luminous efficiency and also improves operating voltage margin.

An improved dark screen contrast ratio is achieved by utilizing the row drivers 715 during the setup period to create a setup voltage waveform that applies the floating voltage Vscan to inner scan electrode 283 during the rising setup ramp (see FIG. 3, time t5 to time t10). The setup voltage waveform for outer scan electrode 280 does not have this voltage applied, as the scan side waveform generator 710 at time t10 reduces its output from a setup voltage Vw by an amount equal to the offset of floating voltage Vscan, e.g., 75-150 volts, or more typically, 90-120 volts. With a reduced voltage applied to outer scan electrode 280, a weak positive resistance setup discharge, which occurs during the rising ramp (time t5 to time t10), is contained to inner scan electrode 283 where the higher voltage is present and is discouraged from extending to outer scan electrode 280, thus reducing the light produced by the setup discharge.

Applying a higher voltage to the outer electrodes in each split pair, where higher voltages are required, may optimize sustaining discharge characteristics. A high electric field present at sustain gap 286, which is relatively narrow, for example, about 80 microns, offers a relative low initial firing voltage. However the voltage required for the sustaining discharge to spread fully across sub-pixel 292 may be 50 to 100 volts higher depending on dimensions of sub-pixel 292 and gas mixture. As a result, if a single sustain voltage is applied to fully discharge sub-pixel 292, the center region of sub-pixel 292 is over-energized, where as at its extremes it is under-energized. If inner electrodes 225 and 283 are driven with the low ignition voltage, and outer electrodes 220 and 280 are driven with relatively higher voltage, then improvements in luminous efficiency and lifetime may be achieved.

Figure 8:
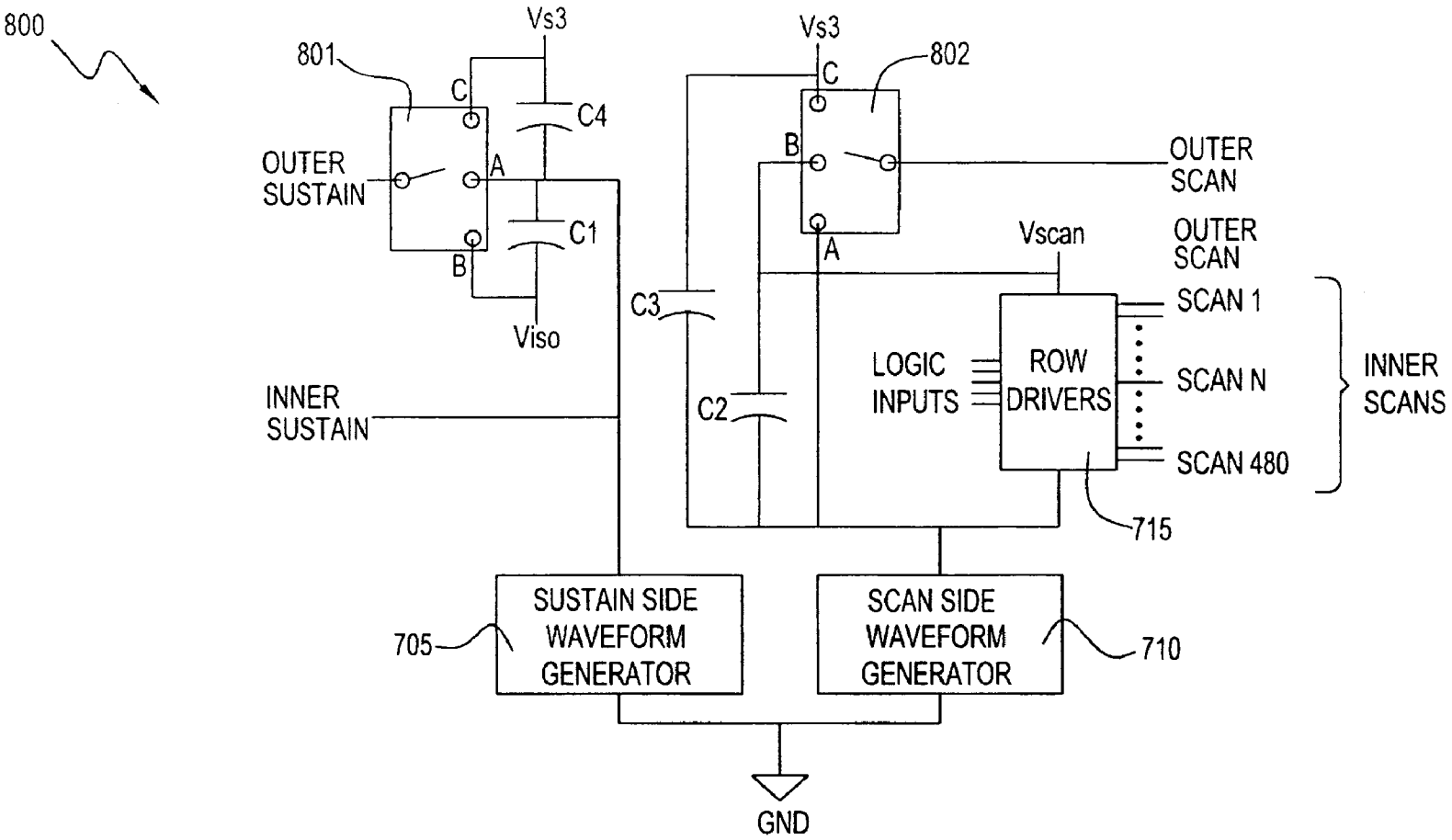
FIG. 8 is a block diagram of a circuit for controlling electrodes of a PDP.
Figure 9:
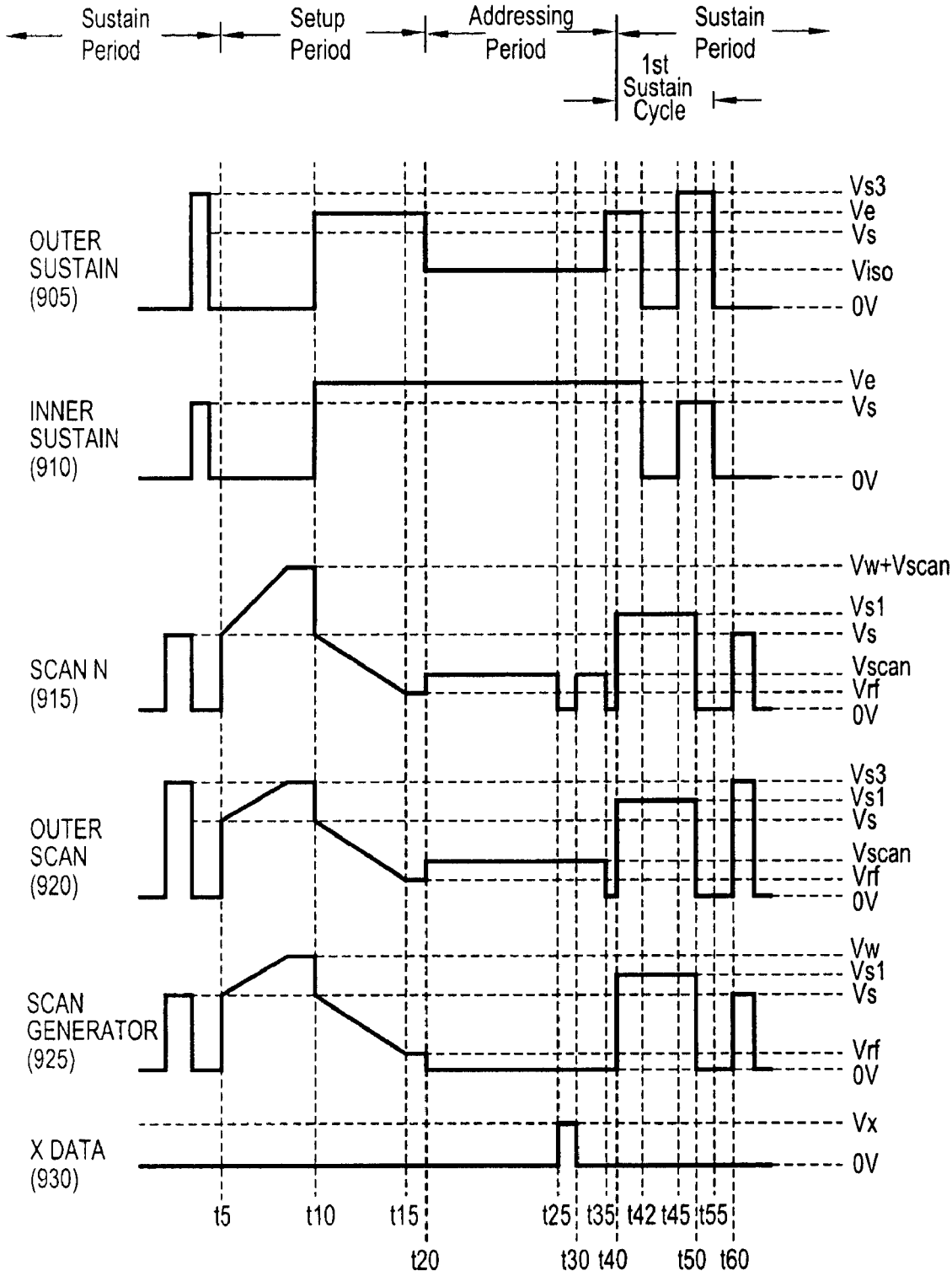
FIG. 9 is a graph of a set of voltage waveforms produced by the circuit of FIG. 8.

FIG. 8 is a block diagram, similar to FIG. 7, of a circuit 800 for controlling electrodes of a PDP. Circuit 800 is, in turn, composed of smaller circuits for controlling the electrodes. FIG. 9, described below in greater detail, shows a set of waveforms produced by circuit 800.

Circuit 800 includes a switch 801 and a switch 802. Each of switches 801 and 802 have positions A, B and C.

Voltages Vscan and Vs3 are AC coupled from scan side waveform generator 710, through capacitors C2 and C3. Thus, Vscan and Vs3 are floating voltages, that is, they float with the output of scan side waveform generator 710. Capacitor C2 has a voltage Vc2 thereacross. Capacitor C3 has a voltage Vc3 thereacross. Vscan floats above Vsc by voltage Vc2. Vs3 floats above Vsc by voltage Vc3.

Voltages Vs4 and Viso are AC coupled from sustain side waveform generator 705, through capacitors C4 and C1, respectively. Thus, Vs4 and Viso are floating voltages, that is, they float with the output of sustain side waveform generator 705. Capacitor C4 has a voltage Vc4 thereacross. Capacitor C1 has a voltage Vc1 thereacross. Vs4 floats above Vss by voltage Vc4. Viso floats below Vss by voltage Vc1.

Via switch 802, the voltage applied to outer scan electrode 280 can be switched between the output of scan side waveform generator 710 (switch 802 position A), floating voltage Vscan (switch 802 position B), and floating voltage Vs3 (switch 802 position C). Similarly, row drivers 715 can switch each row, independently, between the output of scan side waveform generator 710 and floating voltage Vscan. During a portion of the setup period, switch 802 is set to position A to allow outer scan electrode 280 to be driven directly by scan side waveform generator 710. During the addressing period, switch 802 is set to position B to provide floating voltage Vscan to outer scan electrode 280. During the sustain period, switch 802 is controlled to select floating voltage Vs3 for certain sustain pulses to boost the amplitude of the sustain pulses to outer scan electrode 280.

In circuit 800, in contrast with circuit 700, the high side of row drivers 715 is always connected to floating voltage Vscan. "Latching up" is a parasitic condition caused by high currents flowing in a substrate of an integrated circuit. Actual row driver devices may require that floating voltage Vscan, which is typically a relatively high voltage, be removed during the sustain period to prevent row drivers 715 from "latching up".

Switch 801, during the setup period, is set to position A to allow outer sustain electrode 220 to be driven directly by sustain side waveform generator 705. During the addressing period, switch 801 is set to position B to provide floating voltage Viso to outer sustain electrode 220 to suppress vertical crosstalk. During the sustain period, switch 801 is switched between (a) position C so that floating voltage Vs4 (i.e., Vs+Vc4) is applied to outer sustain electrode 220, synchronously with each sustain side sustain pulse, to provide additional amplitude to each sustain pulse, and (b) position B, between sustain pulses.

FIG. 9 is a graph, similar to that of FIG. 3, of a set of voltage waveforms produced by circuit 800. FIG. 9 shows an outer sustain waveform 905, and inner sustain waveform 910, an inner scan waveform 915, and outer scan waveform 920, a scan generator waveform 925 and an X data waveform 930.

Outer sustain waveform 905 is applied to outer sustain electrode 220. Inner sustain waveform 910 is applied to inner sustain electrode 225. Inner scan waveform 915 is applied to inner scan electrode 283. Outer scan waveform 920 is applied to outer scan electrode 280. Scan generator waveform 925 is generated by scan side waveform generator 710. X data waveform 930 is applied to data electrode 210R.

Relative to FIG. 3, the scan waveform generator voltage Vw in FIG. 9 has been reduced by an amount equal to the offset of floating voltage Vscan, i.e., between 75 and 150V. Since row drivers 715 are referenced to the output of scan side waveform generator 710, row drivers 715 may be switched to output floating voltage Vscan during time interval t5 to t10 to produce the scan N waveform 915, which is applied to the inner scan electrode for row N, i.e., inner scan electrode terminal 283. During the setup period, t5 to t20, switch 802 is set in position A so that the outer scan electrode 280 is driven with the outer scan waveform 920, which is the same as scan generator waveform 925.

At time t5, row drivers 715 are driven high to floating voltage Vscan, which is referenced to the output of scan side waveform generator 710 through a capacitor C2. Since row drivers 715 are referenced to the output of scan side waveform generator 710, and since scan generator waveform 925 ramps at time t5, inner scan waveform 915 follows the ramp with an offset of Vc2 volts. The slow ramp, coupled with the voltage approaching Vw+Vc2, creates a weak non-avalanching positive resistance discharge with inner scan electrode 283 discharging to both data electrode 210R and inner sustain electrode 225. This discharge forms the first half of the background glow intensity of the display. Since inner scan electrode 283 sources this discharge, a lower voltage ramp on outer scan electrode 280 from outer scan waveform 920 does not discharge and thus reduces the size of the physical area being discharged, thereby reducing the background glow intensity.

At time t10, referring to inner scan waveform 915, outputs of row drivers 715 are switched to their low level, which is equal to the output of the scan side waveform generator 710 (see scan generator waveform 925). As scan generator waveform 925 ramps down during time t10 to time t15, inner scan waveform 915 will follow. Recall that during the setup period, switch 802 is set to position A, and therefore, outer scan waveform 920 will also ramp down. As the setup voltage waveform voltage ramps down, a slow positive resistance setup discharge will again occur, this time being sourced by data electrode 210R and inner sustain electrode 225. Since outer sustain electrode 220 and outer scan electrode 280 were not included in the rising ramp's setup discharge between time t5 and time t10, they do not have sufficient wall charge to discharge during the falling ramp between time t10 and time t15, thus the setup discharge is discouraged from extending to outer scan electrode 280 and outer sustain electrode 220. This reduces the light generated by the falling ramp, which accounts for the second half of the background glow's intensity. Outer scan electrode 280 follows both ramps so as to not affect the setup discharges on inner scan electrode 283.

At time t20, the addressing period begins, referring to scan generator waveform 925, the output of the scan side waveform generator is at 0V, and referring to inner scan waveform 915, row drivers 715 switch high, bringing inner scan electrode 283 to the level of floating voltage Vscan. Switch 802 is set to position B during the addressing period, and so, referring to outer scan waveform 920, outer scan electrode 280 is also driven to floating voltage Vscan. Thus, outer scan electrode 280 is excluded from the addressing discharge.

Between times t20 and t35, each row is individually selected by a low going pulse on its respective scan electrode. For example, with reference to inner scan waveform 915, a low-going pulse starting at time t25 corresponds to a selection of row N, i.e., the row containing sub-pixel 292. If present, the coincidence of an image data-dependent X data pulse on data electrode 210R would trigger an addressing discharge at sustain gap 286. The addressing discharge will form between the data electrode 210R and inner scan electrode 283. The discharge quickly creates a positive column region and a negative glow region. The negative glow will stay at inner scan electrode 283 whereas the positive column will spread across sustain gap 286 enveloping inner sustain electrode 225.

Also between times t20 and t35, referring to outer sustain waveform 905, outer sustain electrode 220 is driven with floating voltage Viso. Referring to inner sustain waveform 910, a voltage Ve is applied to inner sustain electrode 225. Floating voltage Viso is less than voltage Ve. By placing outer sustain electrode 220 at a lower potential than that of inner sustain electrode 225, the addressing discharge's positive column is discouraged, i.e., suppressed, from spreading across outer sustain electrode 220. By containing the addressing discharge to the smaller area between inner scan electrode 283 and inner sustain electrode 225, rather than permitting the addressing discharge to extend to either or both of outer sustain electrode 220 and outer scan electrode 280, addressing discharge currents are reduced. As the resistive voltage drop across the inner scan electrode 283, and the row driver 715's output resistance limits addressing margin, reducing the addressing discharge current improves the addressing margin.

During time t42 to time t45, a first sustaining discharge occurs with the sustaining discharge current being sourced from the scan electrode pair, i.e. inner scan electrode 283 an outer scan electrode 280U, to the sustain electrode pair i.e., outer sustain electrode 220L and inner sustain electrode 225. Referring to scan generator waveform 925, scan side waveform generator 710 generates a voltage Vs1, which may be greater than the sustain voltage Vs. Scan generator waveform 925 is used to produce both inner scan waveform 915 and outer scan waveform 920, while inner sustain waveform 910 and outer sustain waveform 905 are switched to ground (0V). Voltage Vs1 is chosen so that the positive column region of the discharge spreads across both inner and outer scan electrodes 283 and 280. Although not shown in FIG. 9, in some embodiments of the invention, particularly where gap 282 is larger than sustain gap 286, a higher voltage is applied to outer scan electrode 280 during the first sustaining discharge so that the sustaining discharge spreads across both inner and outer scan electrodes 283 and 280.

A second, third, and subsequent sustaining discharges occur with sustain and scan side waveform generators 705 and 710 producing sustain pulses of amplitude Vs volts. Synchronously with each sustain pulse edge, switch 801 connects outer sustain electrode 220 to floating voltage Vs4, and switch 802 connects outer scan electrode 280 to floating voltage Vs3. Specifically at time t45, sustain side waveform generator outputs a voltage of Vs, and so, outer sustain waveform 905 applies floating voltage Vs4 (i.e., Vs+Vc4) to outer sustain electrode 220 while inner sustain waveform 910 applies a voltage Vs to the inner sustain electrodes 225. Similarly, at time t60, scan side waveform generator 710 outputs a voltage of Vs (see scan generator waveform 925), and so outer scan waveform 920 applies a floating voltage Vs3 (i.e., Vs+Vc3) to outer scan electrode 280 while scan N waveform 915 applies a voltage Vs to the inner scan electrode 283.

Sustaining discharges are intended to extend to outer sustain electrode 220 and outer scan electrode 280, and so, voltages, i.e., floating voltages Vs4 and Vs3, applied to outer electrodes 220 and 280 are higher than voltages, i.e., Vs, applied to inner electrodes 225 and 283. With higher voltages available to outer electrodes 220 and 280, larger split electrode gaps 290 and 282 may be realized. For example, split electrode gaps 290 and 282 may be 150% the size of sustain gap 286. Such an embodiment increases the size of the positive column region of the discharge, which has been shown to provide higher luminous efficiency. For further elaboration, see U.S. Pat. No. 6,184,848 to Weber.

The waveforms shown in FIGS. 3 and 9, and the circuits of FIGS. 7 and 8 are described herein as being used with the PDP of FIG. 2. However, the concepts of FIGS. 3 and 9, and 7 and 8 are also applicable to the PDPs of FIGS. 1 and 4-6.

It should be understood that various alternatives and modifications of the present invention could be devised by those skilled in the art. Nevertheless, the present invention is intended to embrace all such alternatives, modifications and variances that fall within the scope of the appended claims.

What is claimed is:

1. A plasma display, comprising a circuit having:

a first input that receives a first waveform;

a second input that receives a second waveform;

an output that provides a driving waveform for an electrode of a pixel in the plasma display; and a switching sub-circuit that (i) routes said first waveform from said first input to said output during a first portion of a setup period to initialize said pixel for an addressing operation, and (ii) routes said second waveform from said second input to said output during a second portion of said setup period.

2. The plasma display of claim 1, wherein said driving waveform has a peak-to-peak magnitude that is greater than a peak-to-peak magnitude of said first waveform, and greater than a peak-to-peak magnitude of said second waveform.

3. The plasma display of claim 1, wherein said first waveform is a DC offset of said second waveform.

4. The plasma display of claim 3, wherein said DC offset is positive.

5. The plasma display of claim 1, wherein said switching sub-circuit comprises transistors in a totem pole configuration.

6. A plasma display, comprising:

a circuit having a totem pole output that provides an output waveform for driving an electrode of a pixel in the plasma display, wherein said pixel, during a setup period, is prepared for an addressing operation, and wherein said totem pole output includes a first transistor that drives said output waveform during a first portion of said setup period, and a second transistor that drives said output waveform during a second portion of said setup period.

7. The plasma display of claim 6, wherein said circuit receives a first input waveform and a second input waveform, and selectively routes either of said first input waveform or said second input waveform through said totem pole output to produce said output waveform, and wherein said output waveform has a peak-to-peak magnitude that is greater than a peak-to-peak magnitude of said first waveform, and greater than a peak-to-peak magnitude of said second waveform.

8. A plasma display, comprising:

a circuit having a totem pole output that provides an output waveform for driving an electrode of a pixel in said plasma display, wherein said circuit receives a first waveform and a second waveform that is positive relative to said first waveform, and wherein said circuit routes said second waveform to said totem pole output during a first gas discharge of said pixel, and routes said first waveform to said totem pole output during a second gas discharge of said pixel.

9. The plasma display of claim 8, wherein said first gas discharge comprises a weak positive resistance discharge during a rising ramp waveform.

10. A plasma display, comprising:

a circuit that provides a first waveform and a second waveform, wherein said second waveform is a voltage offset of said first waveform; and a totem pole circuit having a first input that receives said first waveform, a second input that receives said second waveform, and an output that provides a driving waveform for an electrode of a pixel in said plasma display, wherein said totem pole circuit (i) routes said second waveform from said second input to said output during a first portion of a setup period to initialize said pixel for an addressing operation, and (ii) routes said first waveform from said first input to said output during a second portion of said setup period.

11. The plasma display of claim 10, wherein said driving waveform has a peak-to-peak magnitude that is greater than a peak-to-peak magnitude of said first waveform, and greater than a peak-to-peak magnitude of said second waveform.

12. The plasma display of claim 10, wherein said pixel experiences a weak positive resistance discharge during said first portion of said setup period.

13. The plasma display of claim 10, wherein said wherein said second waveform is AC coupled to said first waveform.

14. A plasma display, comprising a circuit having:

a first input that receives a first waveform;

a second input that receives a second waveform, wherein said second waveform is a DC offset of said first waveform;

an output that provides a driving waveform for an electrode of a pixel in said plasma display; and a switching sub-circuit that (i) routes said second waveform from said second input to said output during a first portion of a sub-field of a frame for illuminating said pixel, and (ii) routes said first waveform from said first input to said output during a second portion of said sub-field, wherein said driving waveform has a peak-to-peak magnitude that is greater than a peak-to-peak magnitude of said first waveform, and greater than a peak-to-peak magnitude of said second waveform.

15. The plasma display of claim 14, wherein said DC offset is positive.

16. The plasma display of claim 14, wherein said switching sub-circuit comprises transistors in a totem pole configuration.

17. A plasma display, comprising a circuit having:

a first input that receives a first waveform;

a second input that receives a second waveform;

an output that provides a driving waveform for an electrode of a pixel in said plasma display; and a switching sub-circuit that (i) routes said first waveform from said first input to said output during a gas discharge that initializes said pixel for an addressing operation, and (ii) routes said second waveform from said second input to said output when enabling said pixel for a gas discharge during said addressing operation.

18. The plasma display of claim 17, wherein said driving waveform has a peak-to-peak magnitude that is greater than a peak-to-peak magnitude of said first waveform, and greater than a peak-to-peak magnitude of said second waveform.

19. The plasma display of claim 17, wherein said first waveform is a DC offset of said second waveform.

20. The plasma display of claim 19, wherein said DC offset is positive.

21. The plasma display of claim 17, wherein said switching sub-circuit comprises transistors in a totem pole configuration.

22. A plasma display comprising a circuit having:

a first input that receives a first waveform;

a second input that receives a second waveform, wherein said second waveform is a DC offset of said first waveform;

an output that provides a driving waveform for an electrode of a pixel in said plasma display; and a switching sub-circuit that (i) routes said second waveform from said second input to said output during a gas discharge that initializes said pixel for an addressing operation, and (ii) routes said first waveform from said first input to said output when enabling said pixel for a gas discharge during said addressing operation, wherein said driving waveform has a peak-to-peak magnitude that is greater than a peak-to-peak magnitude of said first waveform, and greater than a peak-to-peak magnitude of said second waveform.

23. The plasma display of claim 22, wherein said DC offset is positive.

24. The plasma display of claim 22, wherein said switching sub-circuit comprises transistors in a totem pole configuration.

* * * * *